US005379879A

United States Patent [19]

Mantovani et al.

[11] Patent Number: 5,379,879

[45] Date of Patent: Jan. 10, 1995

[54] POSITIONING DEVICE FOR A PIECE GOOD

[75] Inventors: Gianni Mantovani, Bologna, Italy; Joachim Seefeldt, Neuffen, Germany

[73] Assignee: bielomatik Leuze GmbH & Co., Neuffen, Germany

[21] Appl. No.: 139,785

[22] Filed: Oct. 21, 1993

[30] Foreign Application Priority Data

Oct. 21, 1992 [DE] Germany ..... 4235413

[51] Int. Cl.[6] ..... B65G 47/24

[52] U.S. Cl. ..... 198/382; 198/457; 198/726

[58] Field of Search ..... 198/456, 457, 468.8, 198/382, 726, 345.1

[56] References Cited

U.S. PATENT DOCUMENTS

| | | | |
|---|---|---|---|
| 1,733,221 | 10/1929 | Fuller | 198/456 X |
| 2,641,371 | 6/1950 | Webster . | |
| 2,669,342 | 2/1954 | Neal | 198/726 X |
| 2,805,757 | 9/1957 | Rapley . | |
| 2,840,224 | 6/1958 | Lefief | 198/726 X |
| 3,061,303 | 10/1962 | Glasser et al. . | |
| 3,312,326 | 4/1967 | Huppenthal | 198/415 |
| 3,502,194 | 3/1970 | Perry | 198/411 |
| 3,638,538 | 2/1971 | Sullivan . | |
| 3,884,343 | 5/1975 | Stephens et al. . | |
| 4,015,843 | 4/1977 | Tennant . | |
| 4,090,441 | 5/1978 | Muller . | |
| 4,178,118 | 12/1979 | Bailey . | |
| 4,203,694 | 5/1980 | James | 198/456 X |
| 4,341,299 | 7/1982 | Walker et al. . | |
| 4,381,108 | 4/1983 | Newsome | 198/456 X |
| 4,489,533 | 12/1984 | Trieber | 198/345.1 X |
| 4,756,400 | 7/1988 | Funo et al. | 198/726 X |
| 4,767,116 | 8/1988 | Eberle | 198/456 X |
| 4,895,244 | 1/1990 | Flaugher et al. . | |
| 5,081,821 | 1/1992 | Meives . | |
| 5,141,096 | 8/1992 | Strasser et al. | 198/411 |

FOREIGN PATENT DOCUMENTS

| | | | |
|---|---|---|---|
| 2520337 | 7/1983 | France . | |
| 446779 | 6/1927 | Germany . | |
| 1105384 | 4/1961 | Germany . | |
| 1109642 | 6/1961 | Germany . | |
| 1150354 | 6/1963 | Germany . | |
| 1756752 | 5/1970 | Germany . | |
| 3221601 | 3/1983 | Germany . | |
| 3235873 | 4/1983 | Germany . | |
| 3403909 | 8/1985 | Germany . | |
| 3603484 | 8/1987 | Germany . | |
| 3629914 | 8/1987 | Germany . | |
| 4000263 | 7/1991 | Germany . | |
| 9109971 | 10/1991 | Germany . | |
| 4125896 | 8/1992 | Germany . | |
| 625183 | 9/1981 | Switzerland . | |
| 0595228 | 2/1978 | U.S.S.R. | 198/456 |

*Primary Examiner*—D. Glenn Dayoan
*Attorney, Agent, or Firm*—Quarles & Brady

[57] ABSTRACT

The parcel (2) during the conveying with a conveyor (30) is drawn in on the back (7) by angular profiles (16,17) guided in sloping movement paths and which accelerate the parcel (2) accompanied by the alignment of the rotated position and/or its transverse position, transfer same to a stationary surface area (11) and engage same with a stop (12). The angular profiles (16,17) and the stop (12) then form a sliding shaft from which the aligned parcel (2) with a lifting table (32) can be ejected e.g. into a packing station.

30 Claims, 1 Drawing Sheet

1
30
2
7
5
14
40
13
35
37
36
38
3
8
4
34
27
26
23
6
43
42
17
21
18
19
24
20
31
33
39
16
44
25
13
14
22
41
11
12
15
32
10
28
9
29

POSITIONING DEVICE FOR A PIECE GOOD

BACKGROUND OF THE INVENTION

The invention relates to a positioning device with which a package or parcel in a predetermined movement path or a positionally fixed position can be made ready in such a way that it is aligned in accordance with one, two or three space axes at right angles to one another with respect to a reference plane, reference point or a base.

In at least one of the space axes, the parcel can have an irregular or regular rounded or angular shape, particularly an external shape, e.g. triangular, rectangular, square, etc. Furthermore, at least on placing on a surface area the parcel can be substantially flexurally rigid and at right angles to the surface area substantially incompressible, but parallel to the surface area it is not shear-resistant, but instead deformable, such as is e.g. the case with a parcel formed from a plurality of equally large sheet layers superimposed in edge-flush manner in a stack, which can be moved against one another parallel to their planes or away from one another at right angles to their planes.

In the state compressed as a result of the weight force of the sheet layers, the parcel forms a strictly rectangularly bounded parallelepiped, which can be very dimensionally stiff, although its individual layers have thicknesses of less than 0.1 or 0.2 mm and in the case of paper or paper-like materials has a much higher flexibility than e.g. metallic materials with roughly the same dimensions.

The parcel is in particular aligned for a following working or processing, e.g. it can be aligned with respect to a packing station, in which in a precisely predetermined position it is brought together with a still substantially spread out, flexible packing wrapper and the latter is then placed around the parcel. This can e.g. take place in that the parcel is aligned between walls arranged in box-like manner and its four outsides at right angles to a base face and at right angles and parallel to one another can slide on the wall insides.

OBJECTS OF THE INVENTION

An object of the invention is to provide a positioning device, which avoids the disadvantages of known constructions or of the described type and which in particular with limited loading of the parcel ensures an increased working speed.

SUMMARY OF THE INVENTION

According to the invention the alignment can be brought about in that the aligning faces act on closely defined zones of the parcel and therefore introduce aligning forces into the parcel, which are approximately parallel to one, two or three of the space axes can act in oppositely aligned manner as a function of the divergence from the desired alignment state.

Advantageously two or three alignment movements approximately at right angles to one another or to the space axes can be so superimposed that between at least two alignment movements with respect to the movement path there is a reduction ratio between 5:1 and 18:1, particularly between 10:1 and 14:1 and as a function of the level of the alignment resistances any integral multiple between these limits can be advantageous.

The alignment along the relatively longer movement path can simultaneously be used for transporting or conveying the parcel, e.g. to an aligned readiness position defined by a stop and/or interruption of the drive. Simultaneously with this conveying movement the parcel can be aligned in a direction at right angles thereto about a relatively smaller path and optionally can be aligned in a further direction at right angles to the two aforementioned directions about a relatively smaller path, namely at right angles to its base face.

This final orientation can take place in simple manner in that the parcel is moved with its base face on a correspondingly aligned surface area. As a result of this construction the alignment base does not have to be moved with respect to the device socket and instead the parcel can be moved and be simultaneously transferred from one station, e.g. a stacker, to a further working station, in which it arrives in precisely aligned manner according to two space axes approximately parallel to the surface area and is stopped.

Advantageously the aligning movements do not take place in a vertical direction, but in a direction diverging therefrom, e.g. approximately horizontal, the surface area advantageously diverging from a vertical position, namely being provided as a supporting surface for receiving the weight on the underside of the parcel. In the case of a shear-flexible parcel in one direction or plane there are appropriately two alignment movements roughly parallel to said direction or plane or in the case of stacking layers parallel to the planes thereof. In this case the aligning faces advantageously uniformly engage over the entire extension of the parcel, which is at right angles to said planes. The alignment faces are engaged substantially simultaneously by transverse movements with the associated opposite faces of the parcel over its entire associated extension.

The alignment face can be tilted in self-adjusting manner by at least a few radians about an axis roughly parallel thereto or roughly at right angles to the surface area and at the most having a limited spacing therefrom, so that under the engagement forces it is automatically adjusted into a substantially whole-surface engaging position and does not merely engage on the parcel in punctiform or linear manner. Moreover, at least over part of its regulating distance the alignment face can be deflectable in a direction away from the parcel against a restoring force, so that it has a relatively gentle aligning action on the parcel. Only at the end of the regulating distance thereof is the alignment face rigidly or positively supported against such deflection movements, so that in said final phase the parcel is forced into its predetermined alignment position. In this final phase the alignment face can move in outwardly directed manner on an arcuate path through which the said reduction ratio in the final phase is reduced.

Particularly rapid working can be obtained if the alignment faces take the parcel from a conveyor moving at a uniform speed and which appropriately forms a substantially continuous extension of the surface area and on which the parcel can be roughly prealigned transversely to the conveying direction before it slides onto the actual surface area. The alignment faces can have a higher conveying speed than the conveyor, so that in the manner of slide members they fetch the parcel on the back and after running onto the parcel they move the same with a correspondingly higher speed and in sliding manner with respect to the conveyor and the following parcel. On reaching the aligned readiness position the alignment faces are then stopped, so that they continue to secure he parcel and form a sliding guide at right angles to the surface area along which the parcel can be transferred into the processing position of the associated working station. During this process step the following parcels are conveyed on at the same speed, the intermediate spacings between the successive parcels being selected in such a way that the alignment faces are freed from the parcel transferred into the working position before they have to be moved again for making over a following parcel.

BRIEF FIGURE DESCRIPTION

These and further features can be gathered from the claims, description and drawings and the individual features, both individually and in the form of subcombinations, can be realized in an embodiment of the invention and in other fields and can represent advantageous, independently protectable constructions for which protection is hereby claimed. An embodiment of the invention is described hereinafter relative to the drawings, wherein show:

FIG. 1 a positioning device according to the invention in plan view and in simplified form.

FIG. 2 a movement sequence of the positioning device in a diagrammatic representation.

DETAILED DESCRIPTION OF PREFERRED EXAMPLE EMBODIMENT

Figures 1, 2:
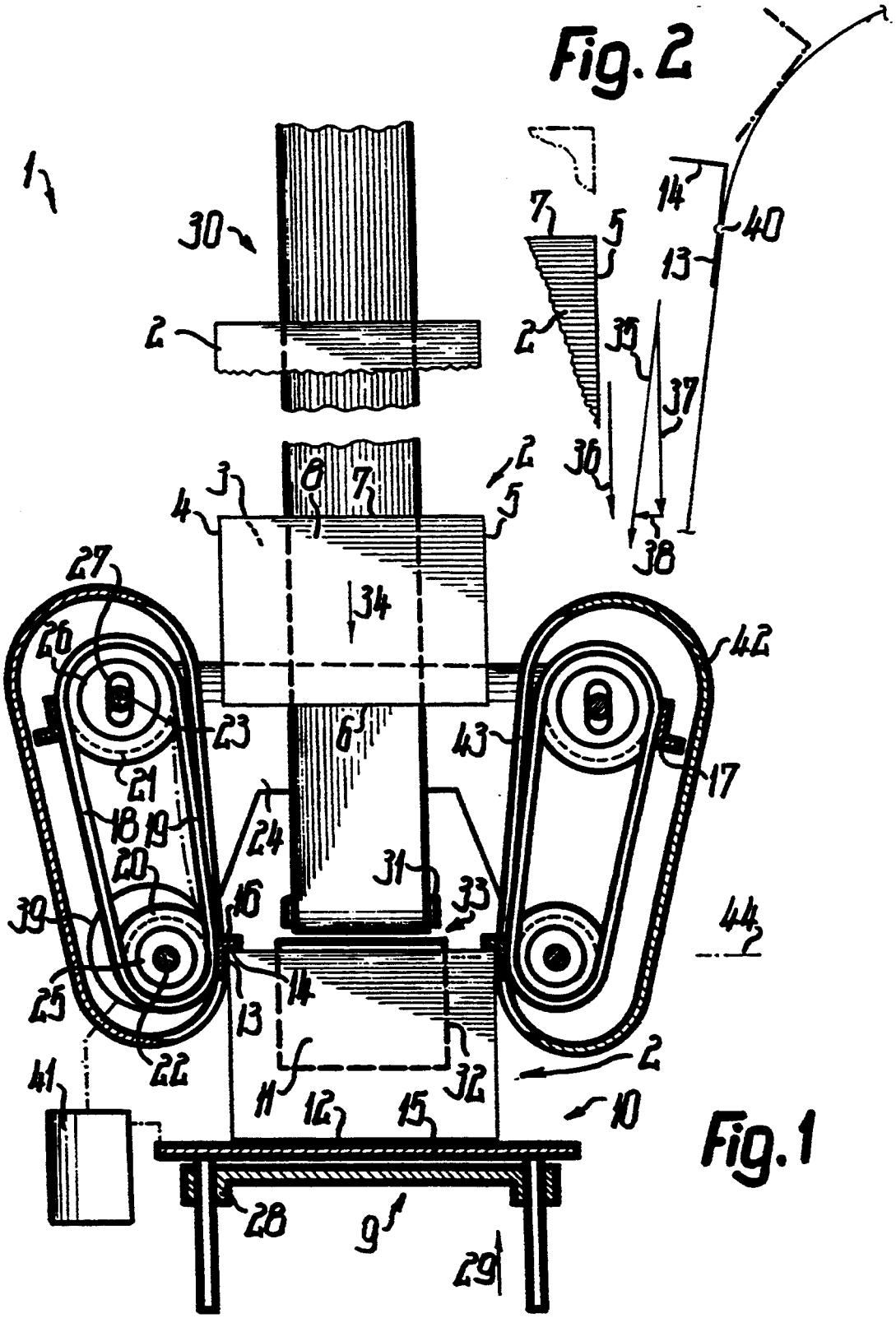

The positioning device 1 is used for conveying in parcels 2, e.g. reams of paper having in each case at least one or more hundred sheets, to a working station, in which the parcel 2 arrives in precisely aligned manner in a view of the underside or base face 3, so that through a movement at right angles to its base face it can perform the working movement associated with the working station. At right angles to the planar base face 3, the parcel 2 has pair-wise facing, planar side faces 4 to 7, which are at a right angle to one another and which are connected to one another in right-angled, sharp corner zones. The base face 3 is faced in parallel manner by an equally large, planar top face 8.

The device 1 e.g. has a frame-like device socket or base 9, which defines an alignment base 10, with respect to which the parcel both in plan view and in a view of each side face 4 to 7, is to assume a precisely defined, fixed position. The height position is determined by a substantially planar surface area 11 on which the parcel 2 rests with the base face 3. A precise alignment at right angles to the side faces 6,7 is defined by a through-planar aligning face 12, which is used for the whole-surface engagement of the side face 6 and in a view of the surface area 11 is at a distance from the latter which can be approximately ⅓ of the distance between the side faces 6,7.

In the readiness position according to FIG. 1 the alignment face 12 is faced by approximately parallel and planar alignment faces 14, which are intended for the engagement of the lateral face 7 with face portions which only correspond to ½ to 1/12, particularly 1/5 to 1/10 of the total surface of the side face 7, To each alignment face 14 is connected in rigid association a planar alignment face 13 approximately at right angles thereto and which is intended for the engagement of the in each case associated side face 4 or 5 with a face portion, which can also be of the same order of magnitude as indicated hereinbefore. Alignment faces 13 are only provided in the spaced manner from the alignment face 12, namely in the vicinity of the corner zone of the parcel 2 bounded by the side face 7, so that over most of its extension the parcel does not directly engage on the alignment faces between the side faces 6,7 and the side faces 4,5. All the alignment faces 12 to 14 extend over at least the total height of the parcel 2.

At least one, namely the-alignment face 12 is larger than the associated side face 6, so that it projects over the base face 3, the top face 8 and/or the side face 4 or 5 and the side face 6 engages in substantially whole-surface manner thereon. The alignment face 12 is formed by a plate face of a plate-like alignment body 15, which is appropriately substantially vertical. In each case one pair of alignment faces 13,14 bounding a reentrant corner zone is formed by a cross-sectionally angular alignment body 16 or 17, which is angularly formed over its entire length as a constant, through profiled bar and extends roughly at right angles to the surface area 11 or approximately parallel to the alignment face 12. The angle side forming the wider alignment face 13 is longer than the angle side forming the narrower alignment face 14. In plan view each alignment face 14 has a side spacing from the surface area 11, whilst each alignment face 13 in the readiness position is at a comparatively larger spacing from the alignment face 12. The angle between the alignment faces 13,14 substantially precisely corresponds to the angle between the associated side faces 4,7 or 5,7 in the vicinity of the corner zone of he parcel 2.

The alignment face 12 in the manner of an end stop is not moved by a direct drive or substantially fixed, whilst the alignment faces 13,14 are movable with the parcel 2 at right angles against the alignment face 12 by means of a drive. For this purpose the alignment body 16 or 17 is fixed to two substantially identical support members 18, which are spaced from one another transversely to the surface area 11 or parallel to the alignment face 12 and in whose longitudinal direction the alignment body 16 or 17 is substantially rigidly or positively fixed.

The support members 18 are appropriately formed by roller chains, toothed belts, etc., so that they can be driven in slip-free manner. The strand 19 of each support member 18 facing the parcel 2 in a view of the surface area 11 according to FIG. 1 is under an acute angle of less than 30,20,15 or 10° to a plane at right angles to the faces 11,12 or to the associated side face 4 and 5 and approaches the centre of the alignment face 12. Through this position of the strand 19 the aligning-active movement path of the associated alignment face 13,14 is defined. The support members 18 are guided in endless manner about two reversing or deflecting means 20,21 in the form of chain wheels succeeding one another at right angles to the alignment face 12, the deflecting means closer to the alignment face 12 having a ⅓ smaller deflection radius. With respect to the median plane of the alignment base 10 at right angles to the faces 11,12, the spindles 22 of the front deflecting means 20 closer to the alignment face 12 have a smaller spacing than the spindle 23 of the rear deflecting means 21, but the common axial plane of the deflecting means 22,23 with respect to the strand 19 is under an angle with the alignment face 12 of a few radians. Two or more alignment bodies 16,17 can be equidistantly spaced over the length of each support member 1B and act successively for the orientation of successive parcels 2, so that a rapid working sequence is possible for relatively low circumferential speeds and an always identical rotation direction.

The support members 18 or reversing means 20,21 are mounted on a bracket 24, which is continuously adjustable on the socket 9 transversely to the aligning face 12 or roughly parallel to the surface area 11 and which can be fixed in the in each case set position. In addition, the support members 18 or strands 19, including the deflecting means 20,21, are correspondingly adjustable and fixable at right angles to said median plane or roughly parallel to the faces 11,12. Therefore the device 1 can be set to parcels 2 with different sizes. The transverse adjustability can be so forcibly oppositely synchronized, e.g. by linkages or the like, that both strands 19 always have the same distance from said median plane.

The shafts of the deflecting means 20,21 are in each case mounted in bearings 25,26, which are adjustable in the described manner. With the rear bearing 26 is associated a tensioning device 27 through which the associated support member 18 can be continuously tensioned and secured in the set tension state. Between the two end deflecting means 20,21 the strand 19 is not supported on the inside and is instead inwardly pressable against its tensile stress into a flat arcuate position, such an arcuate position being shown by dot-dash lines to the left in FIG. 1. The resilient tension acting against the deflection is greatest directly adjacent to the particular deflecting means 20,21 and constantly decreases towards the centre of the length of the strand 19, where it is smallest. This length is greater than the corresponding length of the parcel 2 and smaller than twice this.

The alignment body 15 is mounted in a bearing 28 of the socket 9 at right angles or transversely to the alignment face 12, e.g. in that on the back of the alignment body 15 there are several spaced sliding bars, which run in sliding sleeves. However, the alignment body 15 is only movable against a relatively large resistance by pressure against the outer face 12, because a counterforce 29 acts against this pressure, e.g. a spring arrangement self-restoring the alignment body 15 on release. This arrangement can e.g. be formed by one or more pneumatic piston springs and their resistance force or spring characteristic is continuously variable for adapting to the weight, the frictional resistances, etc. of the parcel 2.

To the side of the surface area 11 remote from the alignment face 12 is connected a conveyor 30 for the parcel 2 located roughly in said median plane and which can e.g. be formed by the upper strand of a belt conveyor and whose supporting face associated with the base faces 3, at least in the area adjacent to the surface area 11 is roughly in a plane therewith or is slightly higher than the same. The surface area 11 is formed by a lifting table 32 movable transversely or at right angles thereto and which can be raised from a roughly equiplanar readiness position facing the conveyor 30 by an amount which is greater than the spacing between the base face 3 and the top face 8 of the parcel 2. The sliding faces 12 to 14 project over the surface area 11 by roughly the same amount and further than the parcel 2, but the lifting table 32 or the surface area 11 can be moved over and beyond the associated ends of the sliding faces.

The front end of the conveyor belt runs over a deflecting or reversing means 31, which in the view according to FIG. 1 only has a small gap spacing from the associated edge of the surface area 11 and is formed by a transfer station 33, on which the parcel 2 can be moved by the moving conveyor 30 on the fixed surface area 11 in such a way that it becomes completely free from the conveyor 30. In the readiness position the surface area 11 or the lifting table 22 is inwardly spaced with respect to one to all the side faces 4 to 7 of the parcel 2, the spacing from the side faces 4,5 being smaller than the spacing from the side face 6 and the associated outer edge being so aligned with the side face 7 that it does not project over the same. The width of the support face of the conveyor 30 is also narrower than that of the parcel 2 and the surface area 11, so that the parcel 2 on either side projects approximately identically far and unsupported in lateral manner over the conveyor 30, which is shown in exaggerated form in FIG. 1. The surface area 11 or the table 2 is appropriately formed from equiplanar or interconnected format parts. By removing or adding such format parts the surface area 11 can be adapted to different plan forms of the parcel 2.

The conveyor 30 conveys the parcel 2 in the conveying direction 34 at right angles to the alignment face 12 with a constant speed and identical intermediate spacings, which roughly correspond to one to two times the associated extension of the parcel 2 or the length of the strand 19, the side face 6 roughly at right angles to the conveying direction 14 forming the front side face and the parallel side face 7 remote therefrom forms the rear side face, whilst the side faces 4,5 are roughly parallel to the conveying direction 34. As soon as the parcel 2 enters the area between the two facing deflecting means 21, the previously stationary support members 18 are put into movement by the drive in such a way that they run in the vicinity of the strand 19 in roughly the same direction as the conveyor 30. The alignment bodies 16,17 intended for alignment purposes are so moved over most of the deflecting means 21 that the alignment faces 14 are initially spaced behind the rear side face 7. On running round the deflecting means 21 the alignment faces 13,14 initially approach the parcel 2 at a speed laterally or transversely to the conveying direction 34 which is higher than the speed components parallel to said direction 34, said speed component being initially smaller than the conveying speed of the conveyor 30.

Subsequently the approach speed decreases and the conveying component of the alignment faces 13,14 increases until, on leaving the deflecting means 21, it has reached the value corresponding to the movement direction and speed of the strand 19 and is substantially constant over its length. On leaving the deflecting means 21 the alignment faces 13,14 are still spaced behind the side face 7, but their speed in the conveying direction 34 is higher than that of the conveyor 30.

In FIG. 2 the movements or movement components are given as speed vectors, namely the sloping adjusting movement of the alignment faces 13,14 in the vicinity of the strand 19 by means of the arrow 35, the conveying speed of the conveyor 30 with the vector 36, the movement component of the alignment faces 13,14 parallel to the conveying direction 34 with the vector 37 and the movement component at right angles to the conveying direction 34 with the vector 38. As a result of the movement 37 being faster than the movement 36 the alignment faces 14 catch up the rear side face 7 after leaving the deflecting means 21 in the area between the first half and the first third of the strand 19 and are applied thereto, initially only engaging over part of the width, whilst the alignment faces 13 are still spaced from the side faces 4,5.

The alignment faces 14 then advance the parcel 2 on the conveyor 30 acting as a sliding face and moving on at the lower speed 36 at the higher speed 37 and slide inwards along the side face 7. Although the parcel 2 is already prealigned on the conveyor 30, but this is within larger tolerances with respect to the lateral alignment transversely to the conveying direction 34 and relative to its rotary position about its axis at right angles to the conveying plane.

If the parcel 2 is slightly twisted on the conveyor 30, then initially only one of the two alignment faces 14 engages with the side face 7 and the parcel 2 slides on the conveyor 30 until the other alignment face 14 engages, so that there is a rotary alignment prior to the lateral alignment. If the parcel 2 is transversely displaced with respect to the lateral faces 4,5 on the conveyor 30, then in the vicinity of the unsupported, free-running strand 17 only one of the alignment faces 13 engages with the associated face 4 or and slidingly moves the parcel 2 on the conveyor 30 towards the other face 5 or 4 and in this case there is no need to overcome any static friction, because due to the faster conveying movement 37 or the rotary movement there is already a relative movement between the parcel 2 and the conveyor 30.

During this alignment phase the free-running alignment body 16 or 17 between the deflecting means 20,21 can give way slightly with respect to the alignment resistance emanating from the parcel 2, because the strand 19 under the pressure against the alignment face 13 can be transferred into the arcuate path indicated in dot-dash line manner, from which it returns resiliently into the linearly extended position on release.

As a result of the inclined path of the alignment body 16, to which the alignment face 13 is approximately parallel and the alignment face 14 approximately at right angles, the alignment face 14 initially only engages with the side face 7 with part of its width, namely following onto the side face 4 or 5 and then subsequently the alignment face 13 only engages with the associated side face 4 or 5 with part of its width connected to its front end. As a result of the internal flexibility of the support member 18 or due to the joint clearance between the chain links, the alignment body 16,17 can be positioned in such a way that it is self-adjusted to the side face 4,5,7 in such a way that its alignment faces 13,14, during the first contact, are aligned parallel to the associated side face. For this purpose the alignment body 16 or 17, can be pivotably mounted in self-adjusting manner, e.g. about an axis of tilt 40 roughly parallel to the two alignment faces 13,14 or roughly at right angles to the surface area 11, with respect to the support member 18, said angle of tilt 40 appropriately being in an area between the centre of the width of the alignment face 13 and its transition into the alignment face 14.

However, in the readiness position the alignment body 16 or 17 is not in the vicinity of the free strand 19 and is instead approximately on the circumference of the associated deflecting means 20, so that it is here positively supported against movements away from the parcel. In the final movement phase the alignment body 16,17, under the progressively increasing, resilient tension, runs onto the deflecting means 20, so that it is positively moved out of the dot-dash line marked arcuate path with an increased alignment speed 38 along the circumference of the deflecting means 20 to the said median plane and consequently in said final movement phase the precise alignment necessarily takes place. In the same way as the rear deflecting means 21, the front deflecting means 20 are in a common axial plane 44 roughly at right angles to the conveying direction 34 and in the readiness position the axial plane 44 passes through the alignment faces 13, particularly roughly through the centre of the width thereof, so that the axial plane 44 is slightly forwardly displaced with respect to the side face 7 in the readiness position.

The alignment bodies 16,17 are driven in precisely aligned manner by a common drive 39 both synchronously and against one another in the conveying direction 34, the drive appropriately acting on the front deflecting means 20 in such a way that the strands 19 are tightened. The drive 39 can be approximately located in the axis of a front deflecting means 20 and the deflecting means 20 can be drive-interconnected in slip-free manner by means of a not shown gear.

With the drive 39 is associated a control device 41, which stops the movement of the alignment body 16,17 in engagement with the parcel 2, when the aligned readiness position is reached. In this position the front side face 6 of the parcel has run against the alignment face 12. If the parcel 2 is still slightly twisted, it initially only runs in one-sided manner onto the alignment face 12 and slides along the latter with a sliding and optionally further rotation on the surface area 11 until the whole of the surface of the side face 6 engages on the alignment face 12. Simultaneously the side face 6 takes with it the alignment face 12 in opposition to the opposing force 29, through which the parcel 2 is pressed against the alignment faces 14. The opposing force 29 can act on the alignment face 12 e.g. in the form of a spring pretension, already in the starting position, in which the alignment face 12 is not yet loaded by the parcel 2. For drive control purposes it is also conceivable to have a cam control or a cam gear with a stationary phase. From the position of the alignment face 12 it is possible to derive a control signal, on the basis of which the control device 41 stops the alignment bodies 16,17 precisely on reaching the aligned readiness position, so that said stoppage does not take place with a resistance emanating from the parcel 2.

In the readiness position the alignment faces 12 to 14 form a conveying or feed shaft at right angles to the surface area 11 and which is much longer than the thickness of the parcel 2 and which in the vicinity of two corner zones at right angles to one another is bounded by relatively narrow angular guides, namely the alignment faces 13,14, and in the vicinity of the transverse face 6 remote therefrom by a planar sliding face, namely the alignment face 12. The parcel 2 is completely free between the sliding faces, which only take up a fraction of the side faces 4,5,7.

In spaced manner above the parcel 2 can be provided a device through which a packing paper or the like can be held ready in a flat spread out position in such a way that it is spaced above the-upper end of the shaft roughly parallel to the base face 3 or the top face 8. On raising the aligned parcel 2 with the lifting table 32 the parcel engages with its top face 8 with the underside of the packing paper and carries the latter with it in its upward movement, so that it can be drawn laterally downwards over the side faces 4 to 7 and then onto the base face 3, which is free in the marginal area due to the limited size of the surface area 11. The parcel 2 completely raised out of the open end of the conveying shaft and which is in this way wrapped, is then supported in the marginal area, so that the lifting table 32 can again be lowered into its starting position and then in the described manner takes over the following, aligned parcel 2. Thus, the alignment bodies 15 to 17 form a sliding shaft transferable from a widened state into a narrowed readiness state, the narrowing movement of the alignment bodies 16,17 being inclined in the described manner and the shaft boundaries 12 to 14 can engage with pretension on at least two remote side faces 6,7.

The support members 18 and the deflecting means 20,21 can be located behind or below the plane of the surface area 11 or the conveying plane of the conveyor 30, so that only the alignment bodies 16,17 project freely over this plane. Appropriately said components are substantially encapsulated in a casing 42 and appropriately on either side of the conveyor belt there are separate casings for the two alignment units.

If said components are completely below the conveying plane, the alignment bodies 16,17 can project through openings in the end walls of said casings. However, it is also conceivable to construct the casing 42 in such a way that in its peripheral wall it has a passage 43 in the form of an opening through which the alignment body 16 or 17 passes out of the casing 42, when it is moved over the deflecting means 21 in the vicinity of the strand 19, so that the alignment body 16 is only located outside the casing for the adjusting path effective for alignment purposes. Following part of the rotation over the deflecting means 20 the alignment body 16 or 17 reenters the casing 42, in which it is located throughout the return travel along the opposite strand.

Each of the said components or arrangements can be provided once, twice or several times, e.g. to simultaneously and/or successively align several parcels 2 in a single positioning device in one or more conveying planes or in one or more aligning stations.

What we claim is:

1. A positioning device for making available at least one piece good (2) in an aligned orientation aligned with respect to at least two perpendicular spacial axes, the piece good having piece faces (3-7), including a base face (3) and first and second side faces (4,5,7), oriented transversely to the piece base face (3), the first piece side faces (4,5) being oriented transverse to the second piece side face (7), said device comprising:

a device base (9);

a motion path (30) including an aligning path (35) for conveying the piece good (2) by conveying motion in a conveying direction (34) transverse to the second piece side face (7), and substantially parallel to the first piece side faces (4, 5), and at least one aligning member (15-17) having aligning faces (13,14), including a shifting face (13) provided to engage said first piece side faces (4, 5), with a contact tension oriented transverse to said first piece side faces (4,5), and to shift the piece good (2) by an aligning motion in at least one aligning direction (38) transverse to said first piece side faces (4,5) into said aligning orientation, wherein on at least a partial section of said motion path (30,35) said shifting face (13) when free of said contact tension is oriented along an unstressed orientation, and wherein while advancing on at least said partial section of said motion path, said shifting face (13) is displaceable counter to said aligning direction (38) and out of said unstressed orientation under action of a reaction force created by said contact tension, said aligning faces including at least one advance face (14) provided for engaging said second piece side face (7) over at least part of said aligning path (35), said advance face (14) positively driving said piece good (2) in said conveying direction and providing a motion face (14) for movably engaging said at least one second piece side face (7), while said piece good (2) moves in said aligning direction (38).

2. The positioning device according to claim 1, wherein said aligning path (35) has an upstream path including a point of initial engagement of at least one of said shifting and advance faces (13, 14) with at least one of the piece side faces (4, 5), at least one of said shifting and advance faces (13,14) being displaceable by said engagement tension counter to said aligning direction (38) when in the vicinity of said upstream path end.

3. The positioning device according to claim 1, wherein at least one of said shifting and advance faces (13, 14) is displaceable counter to said aligning direction (38) over a yielding path, over at least a partial section of said yielding path at least one of said shifting and advance faces (13, 14) being displaceable counter to a resilient force contributing to shift the piece good toward said aligning direction.

4. The positioning device according to claim 1, wherein at least one of said shifting and advance faces (13, 14) is operationally simultaneously moveable along said aligning path and transverse to said aligning path counter to, as well as in, said aligning direction (38), at least one of said shifting and advance faces (13, 14) being operationally forced in said aligning direction (38) by an aligning force increasing at least one of in said conveying direction, and counter to said conveying direction, at least one of said shifting and advance faces (13,14) being substantially untensioned in said aligning direction (38) when not engaging the piece good (2).

5. The positioning device according to claim 1, wherein said aligning path has a downstream path end including a point of final alignment of the piece good (2), at least one of said shifting and advance faces (13,14) being substantially positively supported against motions counter to said aligning direction (38) when in the vicinity of said downstream end.

6. The positioning device according to claim 1, wherein said aligning face (13,14) of at least one of said aligning member (15-17) provides at least one of a first aligning face (13) for engaging the first good side face (4, 5);

second aligning face (14) for engaging the second good side face (7), and a third face (11) for engaging the piece base face (3); and at least one of said shifting, advance and third faces (11, 13,14) being moveably mounted to positionally self-adjust so as to engage the piece good (2) with a minimal specific areal tension.

7. The positioning device according to claim 6, wherein at least one of said shifting, advance and third faces (11, 13, 14) of at least one of said aligning members (32, 15-17) is an inherently substantial stiff and rigid face, said at least one aligning member (32, 15-17) is operationally displaceable counter to said aligning direction (38) while engaging the piece good (2), at least one of said aligning members (32, 15-17) being provided on at least one aligning support (19) commonly displaceable with said aligning member (32, 15-17).

8. The positioning device according to claim 1, wherein at least one of said advance faces (14) of at least one of said aligning members (16, 17) provides a face for positively conveying the piece good (2) substantially parallel to said conveying direction (34).

9. The positioning device according to claim 1, wherein said at least one aligning face (13,14) of at least one of said aligning member (16, 17) provides shifting and advance faces (13,14) reciprocally transversely oriented and reciprocally positionally substantially rigidly connected, said shifting and advance faces (13, 14) being provided structurally substantially in one part at least when engaging the piece good (2).

10. The positioning device according to claim 1, wherein the first side face (4, 5) provides a substantially planar and laterally outermost piece face of the piece good (2), at least one of said aligning face (13) being provided to only partly but areally extendingly, engage the outermost piece face (4, 5) from an upstream end of said aligning path (35) to a downstream end of said conveying path, thereby providing means for leaving a larger remainder of the outermost good face (4, 5) substantially free of engaging contact when moving from said upstream end to said downstream end.

11. The dispenser according to claim 1, wherein at least one of said aligning members (16,17) is provided on at least one aligning support (19), and said aligning support (19) being oblong and defining a length extension substantially parallel to said conveying direction, said aligning support (19) being displaceable counter to said aligning direction (38) over at least a partial section of said length extension commonly with at least one of said aligning members (16,17).

12. The dispenser according to claim 11, wherein at least one of said aligning support (19) defines upstream and downstream support ends, at least one of said shifting and advance faces (13,14) being displaceable between said support ends by a bending deflection of said aligning support (19), in the vicinity of at least one of said support ends, at least one of said shifting and advance faces (13, 14) being substantially rigidly supported against displacement counter to said aligning direction (38) by a convexly arched support face (20, 21), an upstream path end of said aligning path (35) being provided with a spacing downstream of said upstream support end.

13. The positioning device according to claim 12, wherein at said upstream support end at least one of said shifting and advance faces (13, 14) moves over an arched path of a radius greater than at said downstream support end.

14. The positioning device according to claim 1, wherein at least one of said shifting and advance faces (13, 14) is connected to at least two aligning supports (19) displaced reciprocally and with respect to said aligning path in a direction transverse to said conveying direction (34) and the base face (3), at least one of said aligning members (15-17) providing said at least one of said shifting and advance faces (13,14) freely projecting from at least one of said aligning support (19) and commonly with said at least one of said shifting and advance face (13, 34) providing a freely projecting aligning end free of direct transverse support.

15. The positioning device according to claim 1, wherein at least one of said shifting and advance faces (13, 14) is connected to at least one aligning support (19) provided by a substantially endless support member (19) running over at least one return deflection (20, 21) providing a substantially rigid counter support for at least one of said shifting and advance faces (13,14), said support member (19) being flexible and longitudinally pretensioned independent from engaging the piece good (2).

16. The positioning device according to claim 1, wherein said at least one aligning member (15, 16, 17) provides opposing aligning members defining an aligning width and a funnel angle, adjusting means (24) being provided for commonly and counterdirectionally adjusting said aligning members (15, 16, 17) to vary said aligning width by a linear adjusting motion, and said funnel angle by a pivot motion.

17. The positioning device according to claim 1, wherein at least one base support face (30,11) is provided for receiving the piece base face (3), the piece good (2) moving relative to at least one of said base support face (30, 11) when being moved into and deposited in said aligned orientation.

18. The positioning device according to claim 1, wherein the piece good (2) at least laterally freely projects over at least one base support face (30, 11) on at least one of opposing sides, said base support face (30, 11) being provided to receive the piece base face (3).

19. The positioning device according to claim 1, wherein a base support face for supporting the piece good (2) is provided by a driven conveyor (30) connecting to a piece good reception (11) via a transfer section (33), said piece good reception (11) being substantially stationary while the piece good (2) arrives in said aligned orientation, the piece good (2) being freed from said conveyor (30) when in said aligned orientation on said piece good reception (110, said base support face (30), said transfer section (33) and said piece good reception (11) are substantially equiplanar.

20. The positioning device according to claim 1 wherein a positively drivable supply conveyor (30) is provided for supplying the piece good (2) to said aligning path (35) said supply conveyor (30) extending substantially continuously to an upstream conveyor end spaced upstream with respect to said aligning path (35) and at least partly over said aligning path (35), control means (41) being provided for engaging at least one of said shifting and advance faces (13, 14) while continuously conveying the piece good (2), said supply conveyor (30) providing both a conveyor face for synchronously moving with the piece good (20 and a slide face for operationally sliding the piece good substantially parallel to said conveying direction (34), the piece good (2) substantially providing exclusively one single and unscaled piece base face (3) for engaging said conveyor face and said slide face, the piece good being a stack of marginally not interconnected single layer stack layers.

21. The positioning device according to claim 1, wherein a supply conveyor (30) is provided for supplying the piece good (2) to said device (1), control means being provided for displacing the piece, good (2) with respect to said supply conveyor (30) by at least one of said shifting and advance faces (13, 14) in a direction transverse to said conveying direction (34), and a direction substantially parallel to said conveying direction (34), respectively.

22. The positioning device according to claim 1, wherein said aligning path (35) provides chaining path sections laterally flanked by aligning sections of varying aligning angles with respect to said conveying direction (34) said aligning angles increasing downstream of said aligning path (35).

23. The positioning device according to claim 22, wherein said aligning angles progressively and continuously increase, said aligning angles defining flatter and steeper transverse aligning motions of at least one of said shifting and advance faces (13, 14).

24. The positioning device according to claim 1, wherein said aligning path (35) is free of lateral path sections stationarily parallel to said conveying direction (34) apart from said face (13) when in said aligned orientation, thereby avoiding sliding contact of at least one of the first and second piece side faces (4-7) and a top face remote from the base face (3) substantially at the speed of the conveying motion of the piece good (2).

25. A positioning device for making available at least one piece good (2) in an aligned orientation aligned with respect to at least two perpendicular spacial axes, the piece good having piece faces (3-7), including a piece base face (3) and first and second piece side faces (4,5,7), oriented transversely to the piece base face (3), the first piece side faces (4,5) being oriented transversely to the second piece side face (7), said device comprising:

a device base (9):

a motion path (30) including an aligning path (35) for conveying the piece good (2) by a conveying motion in a conveying direction (34) transverse to the second piece side face (7), and at least one aligning member (15-17) having aligning faces (13,14), including a shifting face (13) provided to engage said first piece side faces (4, 5), with a contact tension oriented transverse to said first piece side faces (4,5), and to shift the piece good (2) by an aligning motion in at least one aligning direction (38) transverse to said first piece side faces (4,5) into said aligning orientation, wherein on at least said partial section of said motion path, said shifting face (3) is displaceable counter to said aligning direction (38) and out of said unstressed orientation under action of a reaction force created by said contact tension; and wherein at least one of said aligning faces (13, 14) is operationally positively displaceable by an aligning motion in said aligning direction (38) as a function of motion (37) of the piece good (2) over said aligning path (35), said aligning direction (38) being at least one of oriented substantially parallel to at least one of said aligning faces (13, 14);

oriented substantially at right angles transverse to at least one of said aligning face (11-14);

defined by a pivot motion about a pivot axis (40), and oriented transverse to said conveying direction (34), said at least one aligning face (13, 14) providing a sliding face for slidingly and areally progressively engaging the piece good and for subsequently substantially entirely being engaged by the piece good (2).

26. A positioning device for making available at least one piece good (2) in an aligned orientation aligned with respect to at least two perpendicular spacial axes, the piece good having piece faces (3-7), including a piece base face (3) and first and second piece side faces (4,5,7), oriented transversely to the piece base face (3), the first piece side faces (4,5) being oriented transversely to the second piece comprising:

a device base (9);

a motion path (30) including an aligning path (35) for conveying the piece good (2) by a conveying motion in a conveying direction (34) transverse to the second piece side face (7), and at least one aligning member (15-17) having aligning faces (13,14), including a shifting face (13) provided to engage said first piece side faces (4, 5), with a contact tension oriented transverse to said first piece side faces 4,5), and to shift the piece good (2) by an aligning motion in at least one aligning direction (38) transverse to said first piece side faces (4,5) into said aligning orientation: and wherein while advancing on at least said partial section of said motion path, said shifting face (13) is displaceable counter to said aligning direction (38) and out of said unstressed orientation under action of a reaction force created by said contact tension;

wherein said aligning faces include a third aligning face (12) oriented transverse to said conveying direction (34), means being provided for laterally aligning the piece good (2) and for subsequently aligning the piece good (2) by engaging the piece good (2) with said third aligning face (12) while the piece good (2) is continuously moving in said conveying direction (34).

27. The positioning device according to claim 26, wherein means are provided for driving at least one of said shifting and advance faces (13, 14) substantially positively and slip-free substantially parallel to said conveying direction (34), and wherein a stop face (12) is provided for finally positively stopping the motion of the piece good (2) in said conveying direction.

28. A positioning device for making available at least one piece good (2) in an aligned orientation aligned with respect to a least two perpendicular spacial axes, the piece good having piece faces (3-7), including a piece base face (3) and first and second piece side faces; (4,5,7), oriented transversely to the piece base face (3), the first piece side faces (4,5) being oriented transversely to the second piece side face (7), said device comprising:

device base (9):

a motion path (30) including an aligning path (35) for conveying the piece good (2) by a conveying motion in a conveying direction (34) transverse to the second piece side face (7), and at least one aligning member (15-17) having aligning faces (13,14), including a shifting face (13) provided to engage said first piece side faces (4, 5), with a contact tension oriented transverse to said first piece side faces (4,5), and to shift the piece good (2) by an aligning motion in at least one aligning direction (38) transverse to said first piece side faces (4,5) into said aligning orientation;

wherein while advancing on at least said partial section of said motion path, said shifting face (13) is displaceable counter to said aligning direction (38) and out of said unstressed orientation under action of a reaction force created by said contact tension; and wherein when the piece good (2) is in said aligned orientation a base support face (11) is provided to receive the piece base face (3) and is transversely displaceable commonly with the piece good (2) to eject the piece good entirely out of said motion path.

29. The positioning device according to claim 28, wherein at least one centering shaft is provided for centering the piece good (2) when in said aligned orientation, at least a longitudinal section of at least one of said centering shaft being operationally constrictable in width extension, at least one shaft boundary of at least one of said centering shaft being provided by at least one of said aligning face (11-14), at least one of said centering shaft providing a conveying shaft defining a transfer direction transverse to said conveying direction (34), at least one of said shaft boundaries (11-14) being resiliently retractable and providing a sliding face for the piece good (2) when transferred.

30. A positioning device for making available at least one piece good (2) in an aligned orientation aligned with respect to at least two perpendicular spacial axes, the piece good having piece faces (3-7), including a piece base face (3) and first and second piece side faces (4,5,7), oriented transversely to the piece base face (3), the first piece side faces (4,5) being oriented transversely to the second piece side face (7), said device comprising:

a device base (9);

a motion path (30) including an aligning path (35) for conveying the piece good (2) by a conveying motion in a conveying direction (34) transverse to the second piece side face (7), and at least one aligning member (15-17) having aligning faces (13,14), including a shifting face (13) provided to engage said first piece side faces (4, 5), with a contact tension oriented transverse to said first piece side faces (4,5), and to shift the piece good (2) by an aligning motion in at least one aligning direction (38) transverse to said first piece side faces (4,5) into said aligning orientation, wherein on at least said partial section of said motion path said shifting face (3) is displaceable counter to said aligning direction (38) and out of said unstressed orientation under action of a reaction force created by said contact tension:

wherein the piece good (2) is conveyed in a conveying motion and oriented in an aligning motion transverse to said conveying motion: and wherein control means (41) are provided for substantially entirely stopping motion of at least one of said shifting and advance faces (13, 14) when the piece good (2) arrives in said aligned orientation, said control means (41) being provided to drive at least one of said shifting and advance faces (13, 14) in intermittent steps, each of said steps being provided to align one of a chain of reciprocally following piece goods (2) to said aligned orientation.

* * * * *